US006315862B1

(12) United States Patent
Bergovist et al.

(10) Patent No.: US 6,315,862 B1
(45) **Date of Patent: *Nov. 13, 2001**

(54) PROCESS FOR BLEACHING PULP WITH ADSORPTION OF METALS

(75) Inventors: Anders Bergovist, Karlstad; Hakan Dahllof, Edsvalla, both of (SE)

(73) Assignee: Kvaerner Pulping Technologies, Karlstad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 08/404,908

(22) Filed: Mar. 15, 1995

Related U.S. Application Data

(63) Continuation of application No. 08/086,803, filed on Jul. 7, 1993, now Pat. No. 5,462,641.

(30) Foreign Application Priority Data

Jul. 7, 1992 (SE) ..... 9202125

(51) Int. Cl.[7] ..... D21C 8/147; D21C 9/153; D21C 9/16; D21C 11/00

(52) U.S. Cl. ..... 162/40; 162/65; 162/76; 162/78; 162/79

(58) Field of Search ..... 162/70, 76, 78, 162/79, 37, 57, 65

(56) References Cited

U.S. PATENT DOCUMENTS

| | | | | |
|---|---|---|---|---|
| 3,963,561 | | 6/1976 | Richter . | |
| 4,372,812 | | 2/1983 | Phillips | 162/40 |
| 5,039,022 | | 8/1991 | Nilsson . | |
| 5,143,580 | | 9/1992 | Basta et al. . | |
| 5,145,557 | * | 9/1992 | Peter et al. | 162/40 |
| 5,209,641 | | 5/1993 | Hoglund et al. . | |
| 5,462,641 | * | 10/1995 | Bergvist et al. | 162/78 |
| 5,741,398 | | 4/1998 | Germard . | |

FOREIGN PATENT DOCUMENTS

| | | | | |
|---|---|---|---|---|
| 1206704 | | 7/1986 | (CA) . | |
| 3302580 | | 2/1992 | (DE) . | |
| 0402335 | | 12/1990 | (EP) . | |
| 402 335 | * | 5/1990 | (EP) | 162/78 |
| 9401615 | | 1/1994 | (WO) . | |

OTHER PUBLICATIONS

Liebergott et al., "Bleaching A Softwood Kraft Pulp Without Chlorine Compounds", pp 323–332.

"Emerging Technologies Today and in the Future", Copyright 1992, pp 1–6.

"1981 Oxidative Bleaching", Denver Hilton, Denver, CO., Oct. 22, Copyright 1981, pp 75–78.

Anderson et al., Optimized Hydrogen Peroxide Bleaching in Closed White–Water Systems, pp 111–115.

* cited by examiner

*Primary Examiner*—Steve Alvo
(74) *Attorney, Agent, or Firm*—Jeffrey S. Melcher; Manelli Denison & Selter, PLLC

(57) ABSTRACT

A process for bleaching pulp, in which, after fiber liberation, a first filtrate containing metals, principally in ionic form, is separated off from the pulp, and supplied downstream to the pulp flow after a bleaching stage.

30 Claims, 3 Drawing Sheets

PROCESS FOR BLEACHING PULP WITH ADSORPTION OF METALS

This is a continuation of application Ser. No. 08/086,803, filed Jul. 7, 1993, now U.S. Pat. No. 5,462,641.

FIELD OF THE INVENTION

The present invention relates to a process for bleaching pulp preferably comprising several bleaching stages, in which at a suitable stage after fiber liberation a first filtrate containing metals, principally in ionic form, is separated off from a pulp stream or flow and the pulp stream is subsequently bleached. In a preferred case, the metals and/or metal ions are reintroduced to the fiber stream from which they had been separated. Using the invention, a problem, which is otherwise difficult to solve, namely the problem of discharge of any released metals, is handled in a very simple manner.

BACKGROUND OF THE INVENTION

The environmental authorities are placing ever greater demands on the pulp industry to decrease the use of chlorine gas for bleaching. Permitted discharges of organic chlorine compounds (AOX) with the waste water from bleaching plants have been gradually decreased and are now at such a low level that the pulp factories have in many cases stopped using chlorine gas. Instead, only chlorine dioxide is used as a bleaching agent. Chlorine dioxide forms smaller quantities of AOX than chlorine gas while achieving the same bleaching effect.

However, even the use of chlorine dioxide has been questioned. On the one hand, the environmental authorities in certain countries demand that the discharges of organic chlorine compounds be reduced to such a low level that these demands can scarcely be met even if only chlorine dioxide is used for bleaching. On the other hand, in addition, customers in many countries have begun to demand paper products which are bleached entirely without using either chlorine gas or chlorine dioxide.

The pulp industry is therefore searching for methods which permit bleaching of pulp without using chlorine chemicals. Methods which have been successfully tested involve removing metals in an acid stage (A stage), or possibly by addition of chelating agents (Q stage), e.g. ethylenediamineteteacetic acid (EDTA), to an oxygen-delignified pulp. The pulp is washed and is further bleached using, for example, hydrogen peroxide (P) and/or ozone (Z) in different sequences. One example is the method which is described in European Patent 90850200 (Swedish Patent SE-A-8902058) of EKA NOBEL, the so-called Lignox method. Another known bleaching process includes the bleaching sequences AZ (EOP: alcaline extraction, oxygen, peroxide) where A is an acid stage without use of a chelating agent and Z is as described above.

It is a significant feature of these different methods that certain metal ions have a negative effect on the bleaching process in the form of impaired pulp quality and/or greater consumption of chemicals. In these methods, it has been the practice to wash out the metals by means of an open A/Q stage. A problem which arises in conjunction with these methods is that, as a result, a liquid flow is obtained from the washing stage after release of the metals which contains, on the one hand, a certain amount of released substances which may be toxic or cause pollution and, on the other hand, include dissolved metal ions, which situation is difficult to manage from the point of view of waste and recovery.

According to conventional technology, this filtrate is treated by means of external purification, which can be complicated, time consuming and costly, after which the filtrate is released into a receiver.

SUMMARY OF THE INVENTION

The present invention is characterized in that the separated or released metals are subsequently supplied to a pulp fiber quantity, such as one that has been bleached, which adsorbs or readsorbs the metals and/or metal ions, in which connection the further treatment of the fiber quantity is to a considerable extent not negatively affected by the presence of metals. Using the process according to the invention, it has thus been possible to solve the problems associated with the metal-containing liquid flow, which problems, with currently known methods, cause both increased work and increased costs. With the aid of the invention, this somewhat troublesome problem has thus been solved in a very simple manner by supplying the separated metals to a fiber flow, the further treatment of which is at least not appreciably affected adversely by the presence of the metals.

In what should become the most usual application of the invention, there is only one pulp or fiber line, i.e. only one fiber flow line, and in this case the metals are therefore efficiently reintroduced to the same fiber flow line from which they had been separated at an earlier stage such as before bleaching. It can, however, be advantageous to have at least two parallel fiber flow lines in a pulp plant whereby the separated metals are preferably supplied to one and the same fiber flow, as a result of which it is possible to obtain as final products one or more lateral flows, which may be bleached or unbleached and which have not been supplied with metals, and at least one final product which then has an enriched quantity of metals.

The addition of the metals can take place in a pulp tank or the like or else mixed with a washing liquid for the washing apparatus of the last bleaching stage. In order to ensure that the metals are adsorbed, the pH in the pulp mixture is preferably modified in a suitable well known manner. In addition, supplementary chemicals can be used, for example a retention agent to assist readsorption of the metals.

In a preferred case, the filtrate, after giving up the metals, i.e. adsorption of the metals by the pulp, should be supplied to another part of the process, preferably to an earlier stage. In this way, the degree of adsorption can be significantly increased and the effluent quantity, and consequently the need for fresh water, decreased. This can conveniently be done by the pulp being thickened and washed in a washing apparatus, for example, a washing press, followed by further transport to an additional bleaching step (which is not negatively affected by the metals) with, for example, chlorine dioxide, or to a drying machine, storage tower or paper mill. The filtrate from this washing apparatus is then conveyed, in this preferred case, in a counter-current manner back into the pulp treating process, preferably to the washing apparatus of either the upstream Q stage or the A stage. In addition, the filtrate flow can be divided so that one part can be conveyed back to the washing apparatus of one of the bleaching stages.

BRIEF DESCRIPTION OF THE DRAWINGS

The invention will be described in more detail with the aid of the attached figures in which.

DETAILED DESCRIPTION OF THE INVENTION

Figure 1:
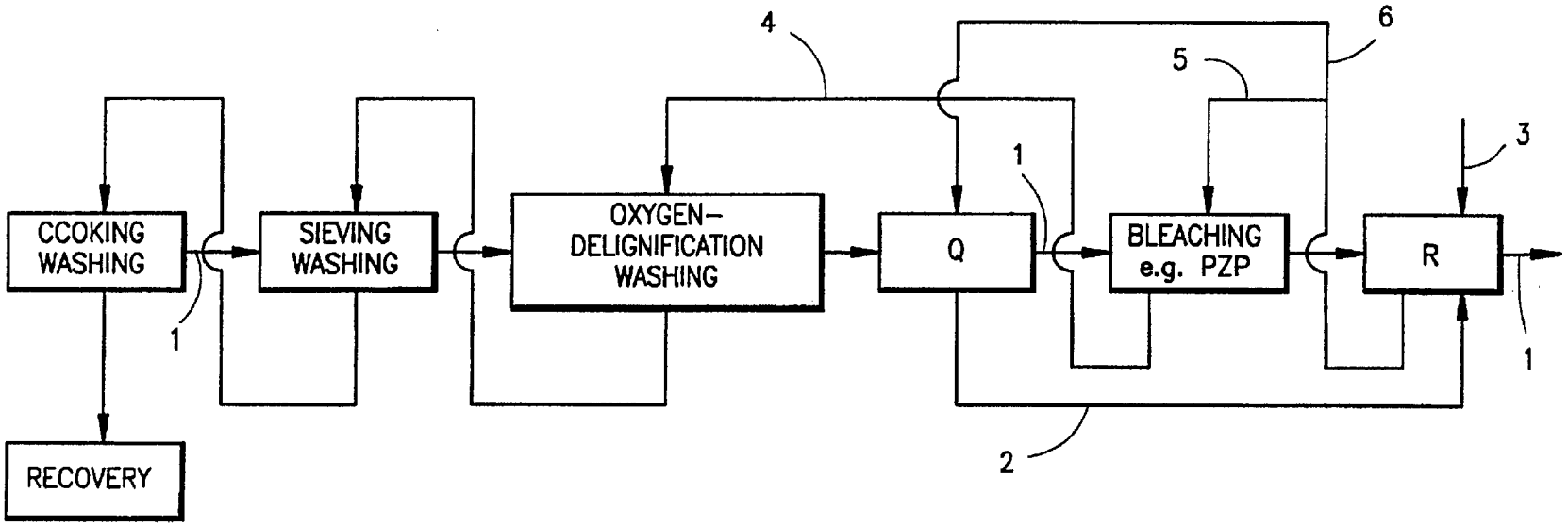
FIG. 1 shows a block diagram of a fiber line in which the invention is used.

FIG. 1 shows a block diagram of a flow line 1 for pulp which is being prepared chemically by cooking. In the preferred case the cooking is continuous such as described in commonly assigned U.S. Pat. No. 3,963,561, the disclosure of which is incorporated herein by reference. After cooking and washing, the pulp is conveyed through the first part of the flow line 1 to an additional washing and sieving stage, followed by oxygen delignification and subsequent washing of the pulp. The next stage is a Q stage where a chelating agent is added such as EDTA. In the Q stage, metals generally in the form of ions are separated, such as by filtering with a sieve or screen, from the fibers in the pulp. Other process steps may, in the alternative be employed such as acidification of the flow by addition of $H_2SO_4$ or DTPA ( pentetic acid) or oxalic acid followed by filtration. The filtrate 2, containing the metals, derived in the Q stage is thus separated from the pulp stream 1, which stream is thereafter conveyed to sequences or steps in a bleaching plant in which processes take place which typically are adversely affected in terms of pulp quality by the presence of any significant quantity of metals in the pulp. Because the metals have been separated in the earlier filtration step Q and passed through a separate conduit at 2, these component processes will be thus be carried out in an improved and more efficient manner.

A bleaching sequence which is negatively affected by metals is, for example, a hydrogen peroxide, ozone, hydrogen peroxide (PZP) bleaching process, comprising an initial and a terminal hydrogen peroxide stage and the intermediate ozone stage. After the pulp has been bleached, there is a stage which is designated R in FIG. 1. In this stage, the metals which were separated off in the earlier filtrate stream 2 are reintroduced. Released organic substances, such as lignin residues, are not adsorbed by the fibers and are washed away in the subsequent washing press or similar washing process. The most preferred method for reintroducing the metals is by addition of a suitable medium for adjusting the pH (for example by means of NaOH), so that the fibers included in the fiber stream can adsorb the reintroduced metals.

As is evident from FIG. 1, a bleaching plant according to the invention is, in the preferred case, one in which the plant can be totally sealed, i.e. there is no effluent from the bleaching plant. According to FIG. 1 this is achieved by conducting a filtrate 4 back from the actual bleaching sequences PZP to the oxygen-delignification and by allowing a first filtrate stream 5 from the R stage to be recirculated to the bleaching sequence steps and, finally, by allowing a second portion of the filtrate stream 6 from the R stage (chiefly the filtrate 2 conveyed to the R stage, but without the metals) to be reintroduced into the Q stage. New washing liquid 3 may be added to the R stage. The final product obtained is a bleached pulp containing metals.

Experiments which have been carried out show that more than 98% of Mn 2+ ions from an acid based bleaching process (A stage) were adsorbed into a fully-bleached pulp at pH values greater than 7. In squeezed filtrate after the mixing, the concentration of Mn 2+ ions was undetectable, i.e. less than 0.05 mg/l. The concentration in the A filtrate was 3.6 mg/l.

Figure 2:
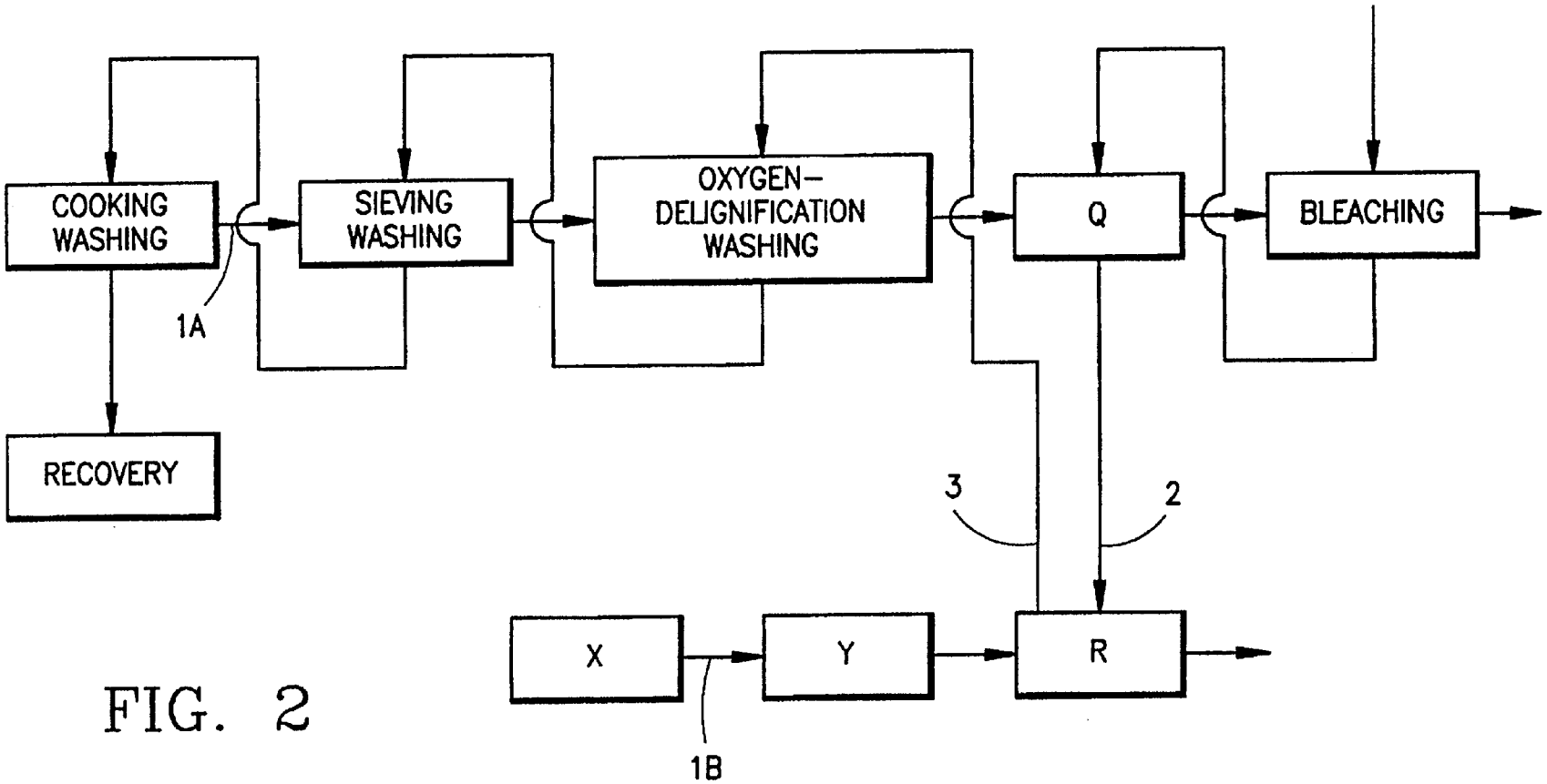
FIG. 2 shows a block diagram of two parallel fiber lines in which the invention is used.

FIG. 2 shows a block diagram of a schematic arrangement where two parallel flow lines 1A and 1B, respectively, are present. The one flow line 1A is for a chemical treated pulp whose final product should have as low a content of metals as possible while the second flow line 1B is for a completely different type of pulp, for example unbleached pulp for which the metal content is of relatively minor importance. As the block diagram shows, the filtrate 2 from the Q stage, where a chelating agent is added, in the first line 1A is conducted to an R stage in the second line 1B where the separated metals are recombined with the pulp. The metals which were separated in the Q stage of the first line 1A are conveyed to the R stage in the second line 1B. In order to ensure liquid balance between the two lines, a filtrate 3 is conveyed back from the R stage in the second line 1B to a sieving or washing stage in the first line 1A. This latter filtrate is naturally a filtrate which does not contain metals.

Figure 3:
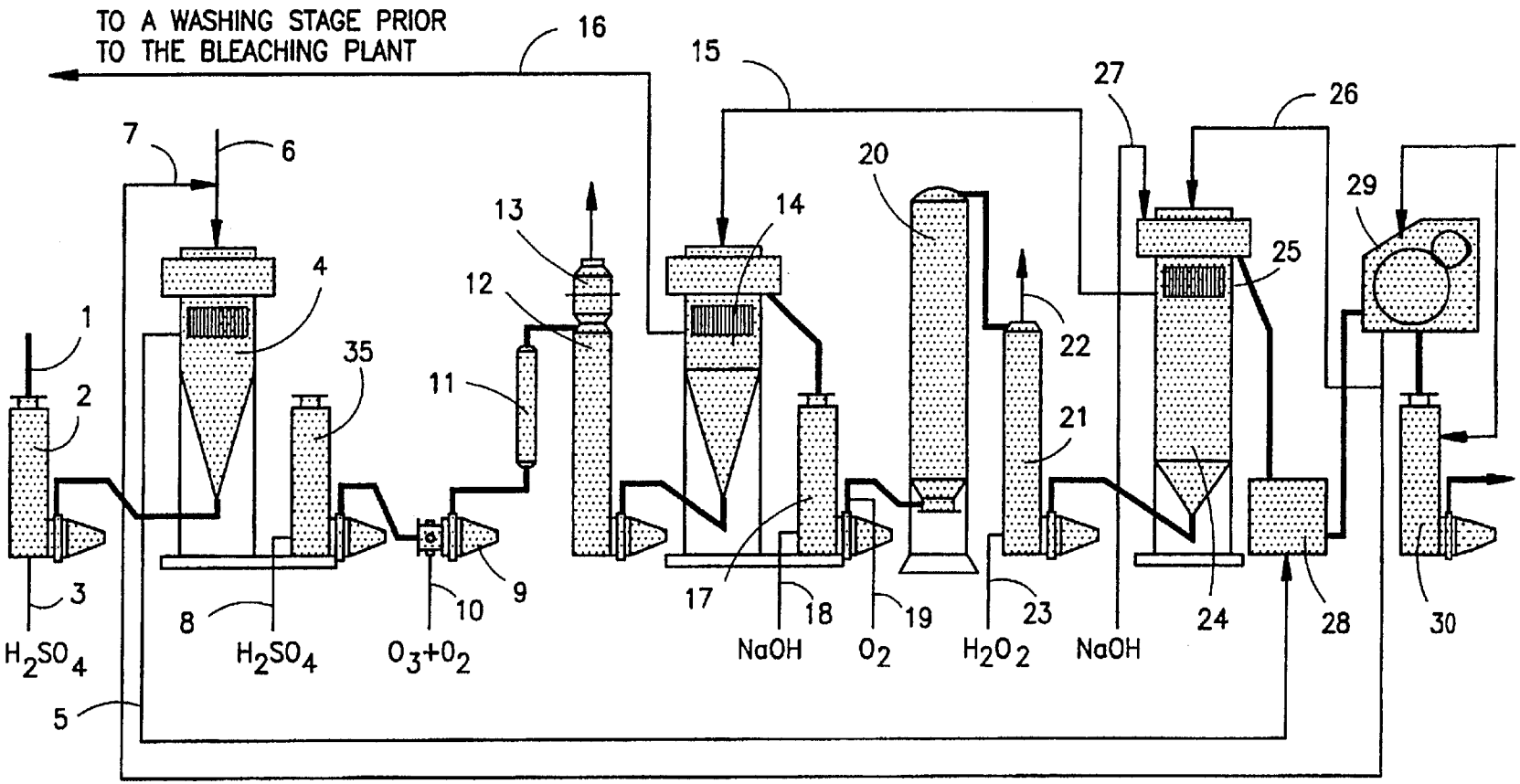
FIG. 3 shows a preferred bleaching plant in conjunction with the use of the invention.

FIG. 3 shows in more detail a preferred bleaching plant with only one flow line for pulp being present. Thus, a diffuser bleaching plant is shown which is constructed for the sequence AZ(EOP). The beginning of the bleaching plant consists of a vessel 2 with a pump to which an acidifier, preferably in the form of sulphuric acid ($H_2SO_4$), can be added via an inlet conduit 3. The pump may be a Kamyr MC type centrifugal pump such as disclosed in U.S. Pat. No. 5,209,641, the disclosure of which is incorporated herein by reference. Next there is a washing apparatus 4 which appropriately comprises a KAMYR® washing diffuser 4. In the washing apparatus 4, the metals contained in the pulp are separated from the fibers and the filtrate 5, which contains the metals, is taken out via a separate conduit 5. Washing liquid for the washing apparatus 4 is supplied via a conduit 7, which comes from a later stage in the process, and, if necessary, also via a separate conduit 6. After the washing apparatus 4, there follows a vessel 35 with an MC pump, in which vessel pH-adjusting substances can be supplied via a conduit 8. Ozone and oxygen are supplied in a subsequent mixer unit 9 and are allowed to react with the pulp in a reactor unit 11. Thereafter the gas and pulp are separated in a separating device 12 from which the gas is conducted away through an upper conduit 13. The pulp is then pumped to a second washing apparatus 14 which is supplied with washing liquid via a conduit 15 from a later bleaching stage. The filtrate which is separated off in the second washing apparatus 14 is conveyed via 16 to a washing stage prior to the bleaching plant. After the washing apparatus, there follows a further vessel with an MC pump 17. Alkali 18, preferably sodium hydroxide (NaOH), is first supplied to this device 17, and then immediately thereafter oxygen 19 ($O_2$), after which the oxygen is allowed to act on the pulp in a reaction tower 20. The oxygen is separated off in a separating device 21 and conducted away at the top 22. Hydrogen peroxide 23 is supplied at the bottom of the separating device, after which the pulp is pumped into a reaction vessel 24 which at the top is fitted with a KAMYR® diffuser washing device 25. It is the filtrate from this washing device 25 which is conveyed back to the previously mentioned washing device 14. Washing liquid for the washing device 25 after the P stage 21 is supplied via a conduit 26 which is connected to a later stage in the process. The pH of the pulp can be adjusted to the desired value via a separate conduit 27.

After the P stage, there follows that stage which earlier in the description was called the R stage 28, which in the present instance can be designated as a pulp mixing vessel 28. The metal containing filtrate 5 is consequently conveyed to this vessel 28 and, with the pH being appropriate adjusted and the fibers in the vessel 28 adsorb the metals. After this, the pulp is conveyed to a washing press 29 in which the pulp is thickened and pumped out to a vessel 30 for further transport to subsequent treatment. The filtrate from this washing press 29, which filtrate is substantially, if not completely, free of metals, is supplied to the first washing device 4 via conduit 7 and/or the washing device 25 of the P stage via conduit 26.

It will be evident to the person skilled in this art that the invention is not limited by that which has been described above, but can be varied within the scope of the subsequent patent claims. Thus, it is evident to the person skilled in the art that the invention can be applied to all types of pulp (the manufacture of) which may conceivably contain some component stage where metals have a negative influence, such as, for example, recovery fiber pulp, mechanical wood pulp (TM pulp, CTM pulp, RM pulp, etc., as defined in U.S. Pat. No. 5,039,022). Furthermore, it will be evident to the person skilled in the art that with a multiplicity of parallel lines there is a large number of combinations which can be selected using the invention in which connection different characteristics can be optimized. For example, a factory comprising three flow lines can have two lines for bleached pulp without metals in the final product and one line for mechanical wood pulp, such as CTMP, in which all the metals are collected, for example for the manufacture of 3-layered composite paperboard comprising two outer bleached layers and a middle metal-containing CTMP layer. This avoids the presence of metal in any outer layer, which can be advantageous for certain uses of the composite paperboard. In addition, it is evident that the equipment which is shown in FIG. 3 is only an example and that the person skilled in the art can easily find alternatives to the equipment shown, such as, for example, a pressure diffuser or a filter as a washing apparatus.

In order, as in a preferred case, to utilize to the full the environmental advantages of the process according to the invention, it is desirable to arrange the subsequent paper manufacture so that the retention of the metals at the wet end of the paper-machine is as great as possible, i.e. so that the metals are chiefly present in the finished paper and not in the waste water from the paper manufacture.

In certain cases it can be preferred to treat the unbleached pulp according to FIG. 2, for example by acidifying it, before supplying the metal-containing filtrate 2 from the parallel line, in order, if possible, to increase, in this way, the ability of the pulp to adsorb metals and/or confer on it selective adsorption capability. In addition, it is perfectly possible to influence the selectivity in the adsorption by the use of supplementary chemicals.

What is claimed is:

1. A process for bleaching pulp comprising the steps of:

separating from a delignified pulp metals and metal ions to a flow of liquid;

bleaching the pulp; and contacting the flow of liquid containing metals and metal ions to the bleached pulp under conditions whereby the metals and metal ions are adsorbed into the bleached pulp to thereby remove said metals and metal ions from the flow of liquid.

2. The invention as claimed in claim 1 including the step of using a chelating agent to separate the metals and metal ions from the delignified pulp.

3. The invention as claimed in claim 2 including the step of using a washing diffuser to assist in separating the metals and metal ions from the delignified pulp.

4. The invention as claimed in claim 2 including the step of adjusting a pH of the delignified pulp by adding a pH adjusting substance to the delignified pulp after the metal and metals ions are separated therefrom.

5. The invention as claimed in claim 4 including the step of second bleaching the pH adjusted pulp by adding at least one bleaching agent to the pH adjusted pulp.

6. The invention as claimed in claim 5 wherein the step of second bleaching includes separating any gas derived and then first washing the second bleached pulp.

7. The invention as claimed in claim 6 including the step of third bleaching by adding alkali and then oxygen to said second bleached pulp.

8. The invention as claimed in claim 7 including the step of fourth bleaching by separating the oxygen from the third bleached pulp and then adding hydrogen peroxide to the third bleached pulp.

9. The invention as claimed in claim 8 including the step of separating filtrate from the fourth bleaching step and using the filtrate in said first washing step.

10. The invention as claimed in claim 9 including the step of second washing the fourth bleached pulp.

11. The invention as claimed in claim 10 including the step of second adjusting the pH of the fourth bleached pulp to enhance the adsorbing of the metals and metal ions into the fourth bleached pulp.

12. The invention as claimed in claim 11 including the step of thickening the fourth bleached pulp and removing excess liquid from the fourth bleached pulp.

13. The invention as claimed in claim 12 wherein the step of thickening the pulp includes using a washing press.

14. The invention as claimed in claim 10 including the step of thickening the fourth bleached pulp and removing excess liquid from the fourth bleached pulp.

15. Process according to claim 1, selectively supplying the pulp and flow of metals and metal ions to one or more of parallel flow lines after the first bleaching step.

16. Process according to claim 1, wherein the bleaching step comprises at least one alkaline extraction and oxygen stage.

17. Process according to claim 1, wherein the bleaching step comprises at least one hydrogen peroxide bleaching stage (P).

18. Process according to claim 1, wherein the bleaching step comprises at least one ozone bleaching stage (Z).

19. The process according to claim 1, further comprising the step of adjusting a pH of the flow of liquid to above 7 to assist in the absorption of metals and metal ions into the bleached pulp.

20. A process for bleaching pulp comprising the steps of:

separating from a delignified pulp metals and metal ions to a flow of liquid;

bleaching the pulp; and contacting the flow of liquid containing metals and metal ions to at least one of the bleached pulp and another pulp under conditions whereby the metals and metal ions are adsorbed into at least one of the bleached pulp and the another pulp.

21. The process according to claim 20, wherein the flow of liquid containing metals and metal ions is contacted with the another pulp whereby the another pulp has an enriched quantity of metals and metal ions and the bleached pulp has a reduced quantity of metals and metal ions.

22. The process according to claim 20, further comprising the step of adjusting a pH of the flow of liquid to above 7 to assist in the absorption of metals and metal ions into at least one of the bleached pulp and the another pulp.

23. A method for bleaching pulp and disposing of metals and metal ions released from said pulp, said method comprising the steps of:

separating pulp metals or metal ions from a delignified pulp to a flow of liquid to produce a pulp having a reduced amount of metals or metal ions;

bleaching said pulp having a reduced amount of metals or metal ions;

contacting said flow of liquid containing metals or metal ions to said bleached pulp to form a mixture of bleached pulp and liquid containing metals or metal ions; and adjusting conditions of said mixture whereby substantially all of at least one metal or metal ion present in the mixture is adsorbed into said bleached pulp.

24. A method according to claim 23, further comprising adjusting conditions of said mixture whereby substantially all of said metals and metal ions are adsorbed into said bleached pulp.

25. A method according to claim 24, further comprising the step of removing a flow from said mixture being substantially free of metals and metal ions.

26. A method according to claim 23, wherein said step of adjusting conditions of said mixture includes the step of adjusting the pH to greater than 7.

27. A method according to claim 23, wherein said step of adjusting conditions of said mixture includes the step of mixing said bleached pulp and said flow of liquid containing metals or metal ions in a pulp tank and adjusting the pH to greater than 7.

28. A method according to claim 23, wherein said step of adjusting conditions of said mixture includes the step of adding chemicals to influence the selectivity of absorption of said metals or metal ions into said bleached pulp.

29. A method according to claim 23, wherein said step of adjusting conditions of said mixture includes the step of adding a retention agent to assist absorption of said metals or metal ions into said bleached pulp.

30. A method according to claim 23, wherein said step of adjusting conditions of said mixture includes the step of adjusting the pH of said mixture to greater than 7 whereby more than 98% of $Mn^{+2}$ ions present in said flow of liquid containing metals or metal ions are absorbed into said bleached pulp.

* * * * *